US007788738B1

(12) United States Patent
Haworth

(10) Patent No.: US 7,788,738 B1
(45) Date of Patent: Sep. 7, 2010

(54) VERSATILE SELF-ADJUSTING ACCESSORIES AND METHODS THEREOF

(76) Inventor: Scarlett Haworth, 5950 Rose Sage St., North Las Vegas, NV (US) 89031

( * ) Notice: Subject to any disclaimer, the term of this patent is extended or adjusted under 35 U.S.C. 154(b) by 310 days.

(21) Appl. No.: 11/863,177

(22) Filed: Sep. 27, 2007

(51) Int. Cl.
*A41B 15/00* (2006.01)

(52) U.S. Cl. ..... 2/279

(58) Field of Classification Search ..... 2/170, 2/144, 145, 156, 157, 301, 311, 312, 316, 2/338, 244, 279; 132/273, 275; 428/4, 5; 223/4

See application file for complete search history.

(56) References Cited

U.S. PATENT DOCUMENTS

| | | | | | |
|---|---|---|---|---|---|
| 854,284 | A | * | 5/1907 | Frost | 2/155 |
| 1,921,271 | A | * | 8/1933 | Lubin | 66/170 |
| 2,019,248 | A | * | 10/1935 | Blumgardt | 2/93 |
| D131,600 | S | | 3/1942 | Holden | |
| 2,665,427 | A | * | 1/1954 | Street et al. | 2/195.7 |
| 2,795,232 | A | * | 6/1957 | Klein et al. | 132/275 |
| 2,844,821 | A | * | 7/1958 | Shurtz | 2/154 |
| 3,063,058 | A | * | 11/1962 | Vollet | 2/338 |
| 3,087,277 | A | * | 4/1963 | McCook | 446/27 |
| 4,277,849 | A | | 7/1981 | Spears | |
| 5,643,643 | A | | 7/1997 | Berstein | |
| 6,397,854 | B1 | | 6/2002 | Bailey | |
| D503,027 | S | | 3/2005 | Strong | |

* cited by examiner

*Primary Examiner*—Gary L Welch
*Assistant Examiner*—Amber R Anderson
(74) *Attorney, Agent, or Firm*—Landaleip, Inc.; David Landman

(57) ABSTRACT

A versatile self-adjusting accessory is disclosed. The accessory has a base member and the base member includes a self-adjusting member of shorter length than the base member, and the self-adjusting member may be coupled to an inner portion of the base member. An end portion of one or more assemblies of streamer members may be coupled to an inner portion of the base member. A portion of the base member may self-adjust to conform to an outer surface of an object when an opposite end of the one or more streamer members is coupled to at least one of a portion of the object and a portion of the self-adjusting accessory. Methods of producing and using the self-adjusting accessory, as well as kit comprising the self-adjusting accessories are disclosed.

9 Claims, 5 Drawing Sheets

VERSATILE SELF-ADJUSTING ACCESSORIES AND METHODS THEREOF

FIELD OF THE INVENTION

This invention generally relates to personalized accessories and more specifically to versatile self-adjusting accessories that may be used in combination with apparel, as bodily adornments, as gift adornments or gift packaging, as household adornments or as fasteners and the like and which therefore have a combination of both ornamental use as well as functional use.

BACKGROUND OF THE INVENTION

In the past, various types of fasteners, connectors, clasps and the like have been used to secure a variety of personal and non-personal objects. Examples include belts, tiebacks, wristbands, headbands, garters, packaging straps, ribbons, and neckbands amongst many others. At times such fasteners may serve both a functional and a decorative purpose. Often, each type of accessory may perform a specific function only.

Lately, consumers have expressed a desire for multiple use objects. Often, an object may be initially purchased for its functional use, and then it may be discovered that it would have been desirable that the object should provide an ornamental function too. In the case of a fashion accessory, if the accessory is no longer fashionable, the tendency may often be to dispose of the accessory rather than to consider other uses for it because such other uses may not be practical based on the single specific use for which it was purchased (namely ornamental). Over time, such a purchase strategy may be expensive and therefore may defer a decision to update such items in favor of remaining unfashionable.

Moreover, accessories that may provide a coordinated appearance when used in a household or with apparel may be desirable too. Such accessories may enhance the appearance of a home, garment or a consumer's bodily appearance.

In some situations, a proliferation of rigid accessories such as plastic hair clasps may take up significant room, as for example in a handbag. Therefore, it would be advantageous, for example, if a garment accessory could be used in versatile ways instead of having multiple non-interchangeable rigid accessories that may need to be carried in a limited sized handbag.

The currently disclosed improved versatile self-adjusting accessories have multiple ornamental and functional uses and may be configured easily to provide much sought after coordinated appearances while being highly functional and adaptable to various needs.

SUMMARY OF THE INVENTION

The versatile self-adjusting accessories disclosed herein are generally easy to use and provide a consumer with multiple options for their use. The various embodiments disclosed herein are meant to be illustrative of the general concept and are not intended to limit any facet of this disclosure.

In accordance with an embodiment of this invention, versatile self-adjusting accessories are disclosed. In an exemplary embodiment a self-adjusting accessory, comprises in combination, a base member having a first end and a second end. An inner portion of the base member may include a self-adjusting member having a first end and a second end. A portion of the first end of the self-adjusting member may be coupled to a portion of the first end of the base member and a portion of the second end of the self-adjusting member may be coupled to a portion of the second end of the base member. Further, the self-adjusting accessory may comprise one or more assemblies of one or more streamer members, each of the streamer members having an end. A portion of each end of each streamer member may be coupled to a portion of the first end of the base member and a portion of each end of another assembly of the one or more streamer members may be coupled to a portion of the second end of the base member. A portion of the base member may self-adjust to conform to an outer surface of an object when at least a portion of at least one of an opposite end of the one or more streamer members is coupled to at least one of a portion of the object and a portion of the self-adjusting accessory.

In another aspect of the disclosure, the self-adjusting member may substantially comprise a stretchable fabric and the length of the base member exceeds the length of the shortened self-adjusting member. Furthermore, the one or more streamer members is at least a fabric selected from the group consisting of a base, a mesh, a lace, a satin, a rick rack and one or more combination of the fabrics thereof.

In accordance with another embodiment of this invention, a method of producing a self-adjusting accessory is disclosed. The method may comprise providing a base member having a first end and a second end. In a further step at least an inner portion of the base member may be coupled to a self-adjusting member having a first end and a second end, the self-adjusting member having a length shorter than the base member. Furthermore, an assembly of components comprising one or more streamer members may be provided, at least one of the streamer members visually distinguishable from another of the streamer members. Yet further, a portion of an end of the assembly of components may be coupled to an inner portion of the first end of the base member and a portion of an end of a second assembly of components may be coupled to an inner portion of the second end of the base member. An inner edge of the base member may be folded to substantially enclose each of the self-adjusting member, an end of each of the assembly of components and the second assembly of components within an inner portion of the base member. Furthermore, a portion of the edge of the base member may be coupled to an opposite edge of the base member to encase the self-adjusting member and an end of each of the assembly of components and the second assembly of components within an inner portion of the base member and thereby provide the self-adjusting accessory.

The foregoing and other objects, features, and advantages of the invention will be apparent from the following, more detailed description of the various embodiments of the invention, as illustrated in the accompanying drawings and photographs.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DESCRIPTION OF THE INVENTION

Figure 1:
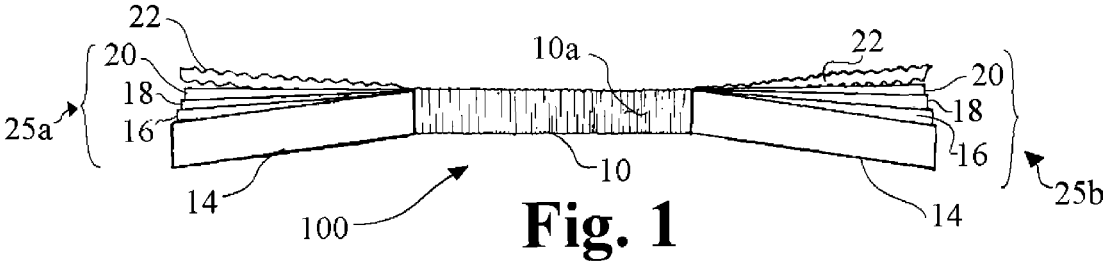
FIG. 1 depicts a side perspective view of an accessory in accordance with an exemplary embodiment of this invention.

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

For clarity and conciseness, several of the drawings show in schematic, or omit, parts that are not essential in that drawing to a description of a particular feature, aspect or principle of the invention being disclosed. Thus, the best mode embodiment of one feature may be shown in one drawing, and the best mode of another feature may be called out in another drawing.

The Figures are numbered and annotated so that one skilled in the art of apparel and personal accessories and construction methods thereof, by reference to the Figures, will easily be able to understand the materials and method of construction and will be able to easily assemble the parts to achieve the functionality shown.

In the Summary and Preferred Embodiments above, the Description of the Invention, and the Claims and Abstract below, and in the accompanying drawings, reference may be made to particular features (including method steps) of the invention. It is to be understood that this disclosure includes most possible combinations of such particular features. For example, where a particular feature is disclosed in the context of a particular aspect or embodiment of the invention, or a particular claim, that feature may also be used, to the extent possible, in combination with and/or in the context of other particular aspects and embodiments of the invention, and in the invention generally.

The term "comprises" and grammatical equivalents thereof are used herein to mean that other components, ingredients, steps etc. are optionally present. For example, an article "comprising" (or "which comprises") components A, B and C can consist of (i.e. contain only) components A, B and C, or can contain not only components A, B and C but also one or more other components.

Where reference is made herein to a method comprising two or more defined steps, the defined steps may be implemented in any order or simultaneously (except where the context excludes that possibility). Moreover, the method may include one or more other steps that may be implemented before any of the defined steps, between two of the defined steps, or after all the defined steps (except where the context excludes that possibility).

The term "at least" as denoted herein means one or more, while the term a "plurality" means two or more.

The term "or" is used herein as a conjunction used to link alternatives in a series of alternatives. The term "and/or" is used herein as a conjunction meaning that either or both of two options may be valid.

The term "and" is used herein as a conjunction to indicate an additional thing, situation or fact.

When used in the appended claims the term "comprising at least one of A and B" as used herein (depending on the context of the specification) may mean: comprising either one of A or of B (and more), or comprising both of A and of B (and more). As is understood in the patent art, "comprising A" means "A and more", while "comprising B" means "B and more". Thus if A is excluded according to the context of the specification in the phrase "comprising at least one of A and B", then A cannot be part of the "and more" and similarly for B if B is excluded according to the context of the specification.

When an element includes a list of numbers following the named element separated by commas, the meaning of this list refers to the named elements in the conjunctive form "and/or", unless otherwise noted. For example, the term: "a member 10, 12, 14, 16, 18" would mean "a member 10 and/or a member 12 and/or a member 14 and/or a member 16 and/or a member 18".

FIG. 1 is a side perspective view of an exemplary embodiment of a self-adjusting accessory 100 comprising a base member 10 and an assembly of components 25*a, b*. Without limiting this disclosure, initial inspection of FIG. 1 shows an outer portion 10*a* of the base member 10 may have a ruffled appearance. Furthermore, each of the assembly of components 25*a, b* and the base member 10 may comprise one or more materials having different shapes, colors, patterns and textures. In an exemplary embodiment the one or more materials may comprise any kind of fabric as is understood in the art.

Figure 1A:
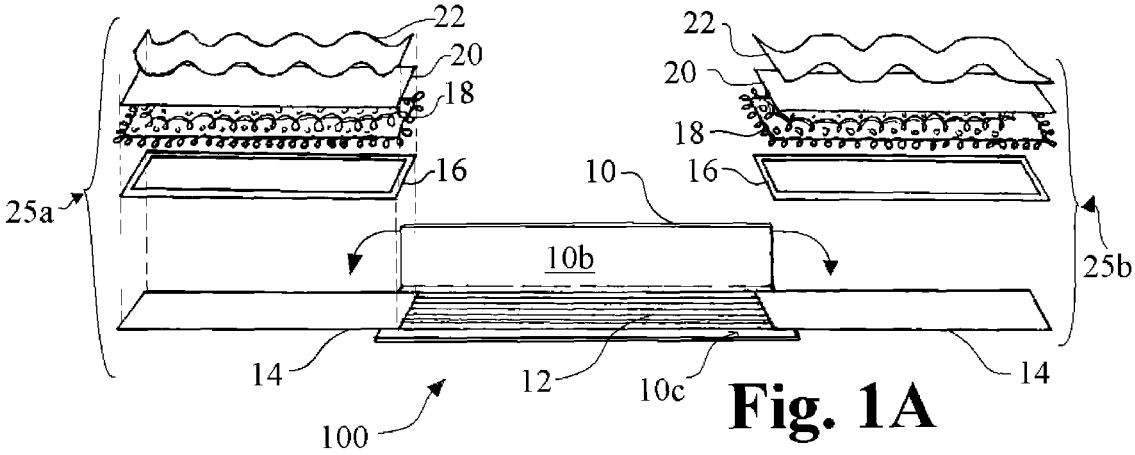
FIG. 1A is a top perspective exploded view depicting various elements of the accessory of FIG. 1.

FIG. 1A depicts a top perspective exploded view of the assembly of components 25*a, b* of the self-adjusting accessory 100 comprising the base member 10 having a first end and a second end. An inner portion 10*c* (or of course, in the alternative, an inner portion 10*b*) of the base member 10 may include a self-adjusting member 12 having a first end and a second end. In an aspect of the disclosure the self-adjusting member 12 may comprise an elasticized fabric and the like that would be stretchable and substantially return to a rest position after being stretched. Thus, as would be understood, when in a rest (or relaxed) state the self-adjusting member 12 would be shorter in length than the base member 10 so that the base member would tend to bunch up to accommodate the shorter self-adjusting member. Without limiting the disclosure, the base member 10 and the self-adjusting member 12 would comprise one or more pliable materials, with the self-adjusting member being more elastic or deformable than the base member. A portion of the first end of the self-adjusting member 12 may be coupled proximate to a portion of the first end of the base member 10, and similarly a portion of the second end of the self-adjusting member may be coupled proximate to a portion of the second end of the base member. Without limiting the disclosure, a portion of the self-adjusting member 12 may be coupled to a portion of the base member 10 with an adhesive or by mechanical means such as with thread and the like or combinations thereof. Of course, when configured in this manner, the self-adjusting member 12 may at least partially provide the ruffled appearance of the outer portion 10*a* of the base member 10 as discussed previously (see above).

Referring further to FIG. 1A, without limiting the disclosure, the assembly of components 25*a* of the self-adjusting accessory 100 may comprise one or more first members 14 having an end, second members 16 having an end, third members 18 having an end, fourth members 20 having an end and fifth members 22 having an end (hereinafter "streamer members"). In an aspect of the disclosure, a portion of each end of the assembly of components 25*a* of the one or more streamer members 14, 16, 18, 20, 22 may be coupled to a portion of the first end of the base member 10. Furthermore, a portion of each end of another assembly of components 25*b* of the one or more streamer members 14, 16, 18, 20, 22 may be coupled to a portion of the second end of the base member 10. Naturally, the assembly of components 25*a, b* may include less or more than all of the streamer members 14, 16, 18, 20, 22. Thus, either of the assembly of components 25*a, b* may include repetitions of one or more of the streamer members 14, 16, 18, 20, 22. To illustrate, and without limiting the disclosure, an assembly of components 25*a* may comprise one first member 14, two second members 16, zero third members 18, three fourth members 20 and one fifth member 22. Similarly, an assembly of components 25*b* may comprise two first members 14, two second members 16, zero third members 18, two fourth members 20 and zero fifth members 22. Thus, the assembly of components 25*a* may have a different number of streamer members compared to another assembly of components 25*b*. Without limiting the disclosure, the remaining description refers to a first assembly of components 25*a* as comprising one each of the streamer members 14, 16, 18, 20, and a second assembly of components 25*b* as comprising one each of the streamer members 14, 16, 18, 20, 22 (see FIG. 1 and FIG. 1A) to clearly illustrate an exemplary embodiment of the disclosure.

An edge of an inner surface 10*b* of the base member 10 may be folded over an opposite edge of an inner surface 10*c* of the base material to enclose the self-adjusting member 12 and a portion of each end of the one or more streamers 14, 16, 18, 20, 22 between the inner surface 10*b* and the inner surface 10*c* of the base member. Of course, a portion of the edge of the inner surface 10*b* may be selectively coupled to a portion of the opposite edge of the inner surface 10*c* with any type of fastener including but not limited to thread, adhesive and the like. Naturally, in other embodiments the base member 10 may comprise two inner portions 10*b* with another inner portion 10*c*, wherein the two inner portions 10*b* fold into and couple to the inner portion 10*c* to enclose the self-adjusting member 12 and any other substructures such as one or more streamers 14, 16, 18, 20, 22 of the self-adjusting accessory 100. Such coupling may be substantially permanent or may be configured in a semi-permanent manner as desired by using a pressure sensitive adhesive or a mechanical hook and loop arrangement as is understood in the art.

Figure 1B:
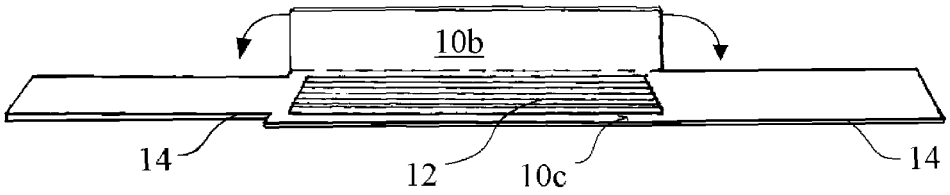
FIG. 1B is a top perspective exploded view of an alternative embodiment of several elements of the accessory of FIG. 1.

With further reference to FIG. 1B, and without limiting the disclosure, the first member 14 may comprise the same material as the base member 10. Thus, in an aspect of the disclosure, the first member 14 and the base member 10 may comprise a single material such as a single length of fabric. At an end of a portion of the self-adjusting accessory 100, the first member 14 may have a different width compared to the base member 10 while at an opposite end of the self-adjusting accessory, the first member may have substantially the same width as the base member. Of course, the first member 14 at each end of the self-adjusting accessory 100 and the base member 10 may have substantially the same dimensions, and thus appear to be a single streamer member.

Referring again to FIG. 1A, the second member 16 may comprise a mesh fabric, which may be substantially translucent. The third member 18 may comprise a lace fabric. The fourth member 20 may comprise a satin fabric. The fifth member 22 may comprise a rick rack (or ric rack) fabric. The term rick rack fabric refers to any fabric that has a substantially zig-zag appearance and may comprise braided as well as non-braided fabrics. Naturally, the above-described fabrics may comprise any conventional fabrics such as knits, mattes and the like currently existing, or any fabrics that may be available in the future. Such fabrics may comprise natural or synthetic fibers including but not limited to metallic, biopolymers (such as, cellulose, rayon, silk, wool, cotton, various papers made from natural fibers and the like), polymeric and co-polymeric (nylon, polyester, acrylic, olefin and the like) and/or combinations thereof. Furthermore, the fabrics may be colorized or patterned with natural or synthetic dyes, pigments and the like and/or combinations thereof as are currently known or that may be available in the future.

Figure 2:
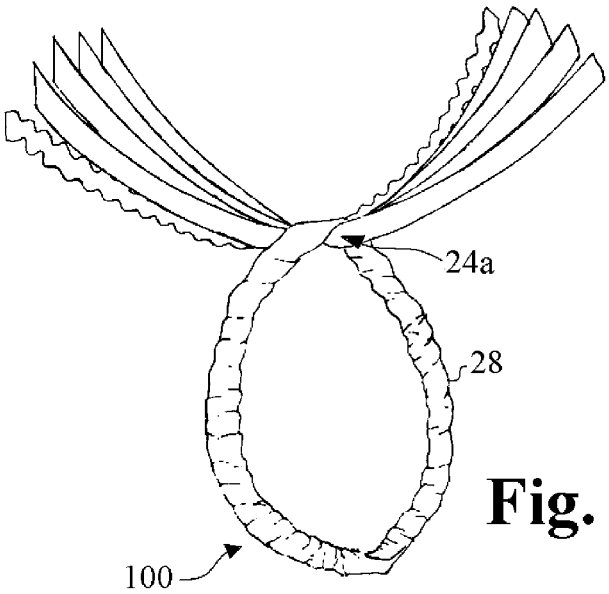
FIG. 2 depicts a side perspective view of the accessory of FIG. 1 with a single knot.

Referring now to FIG. 2, in an aspect of the disclosure, a portion of an end of the self-adjusting accessory 100 may be folded over another portion of the self-adjusting accessory. In the aspect illustrated in FIG. 2, the folded self-adjusting accessory 100 may comprise a portion depicted as a single knot 24*a* and a portion depicted as a substantially closed loop 28. Without limiting the disclosure, the closed loop 28 may be substantially circular or elliptical. Often knots may be easily undone. However, advantageously, since the streamer members 14, 16, 18, 20, 22 may have different textures and different structures (such as the rick rack and lace fabrics), the knot formed from the self-adjusting accessory 100 may inter-lock with improved security.

Figure 2A:
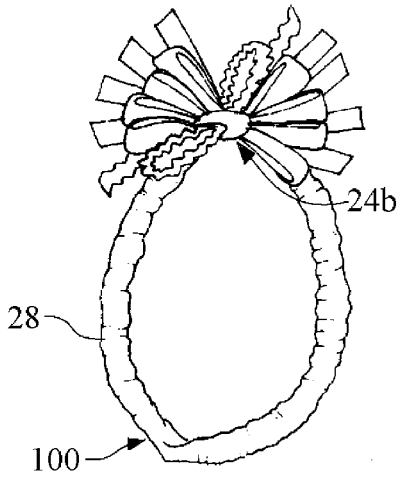
FIG. 2A depicts a side perspective view of the accessory of FIG. 1 with multiple knots and having a generally bow shaped appearance.

FIG. 2A illustrates yet another aspect of the disclosure wherein a portion of an end of the self-adjusting accessory 100 may be folded over with one or more knots 24*b* to provide a bow. Another portion of the bow shaped self-adjusting accessory 100 may include a closed loop 28. In an aspect of the bow shaped self-adjusting accessory 100, the self-adjusting accessory may have a combination of both utility and ornamental appearance. Since the base member 10 includes the self-adjusting member 12, the closed loop 28 as illustrated in FIG. 2 above and in FIG. 2A may be expanded to conform to a shape of a surface of an object enclosed by a portion of the closed loop. The shape of the surface of this object may be regular or irregular and therefore, the self-adjusting member 12 may be advantageously coupled to the object.

Figure 3:
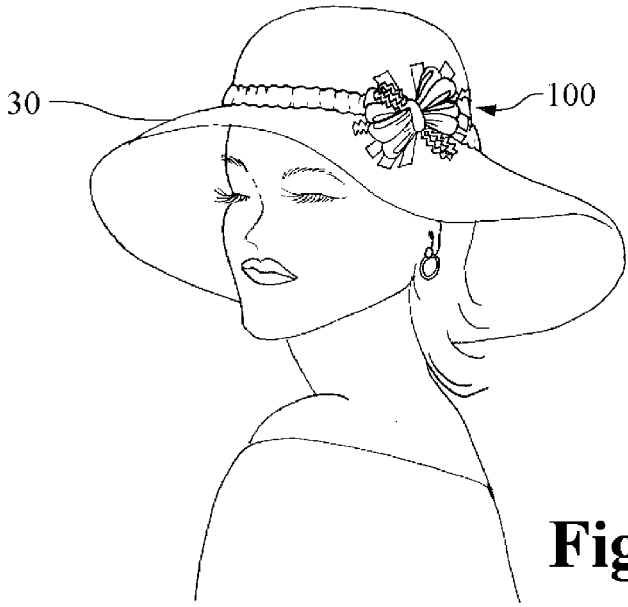
FIG. 3 is a front perspective view of the accessory of FIG. 1 coupled to a portion of a hat according to an embodiment of this invention.

FIGS. 3, 3A, 3B, 3C and 3D illustrate how the self-adjusting accessory 100 may be used as both in a utilitarian fashion, as well as to provide enhanced personal adornment. FIG. 3 depicts a front perspective view of the self-adjusting accessory 100 having a bow with the closed loop 28 coupled about a portion of a hat 30. Since the self-adjusting accessory 100 may be knotted in any manner, the hat may provide multiple appearances according to the desires of a person. Although the decorated hat is shown as being used by a female, naturally, it would be possible for the self-adjusting accessory 100 to be used in the context of a hat for a male with a different knotting arrangement (i.e., not just a bow) as desired. Advantageously, the self-adjusting accessory 100 may be readily sized to any hat circumference or shape and readily used in one hat or another hat with versatility according to a person's needs.

Figure 3A:
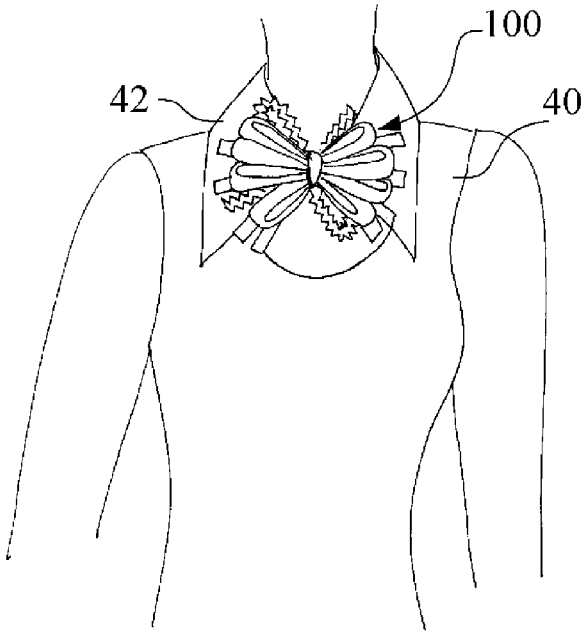
FIG. 3A is a front perspective view of the accessory of FIG. 1 configured as a necktie coupled to a portion of a blouse.

FIG. 3A depicts a front perspective view of the self-adjusting accessory 100 having a bow and configured as a necktie coupled to a portion of a blouse 40. In operation, the self-adjusting accessory 100 may be draped under the collar 42 of the blouse 40. Since the self-adjusting accessory 100 has streamer members 14, 16, 18, 20, 22 located at the end of the base member 10, the streamer members provide enhanced adornment to the blouse 40, which may otherwise be fairly plain. Since the self-adjusting accessory 100 may be draped in a variety of ways, a consumer may readily change their appearance according to situational needs. Furthermore, because the self-adjusting accessory 100 may be light and take up little room in a handbag or a pocket of an apparel outfit, the consumer may advantageously change their appearance to suit any occasion simply by carrying one or more of the self-adjusting accessories 100 at will. Furthermore, rather than simply draping the self-adjusting accessory 100 under the collar 42, the self-adjusting accessory may be tied in a variety of ways including in the shape of a bow as illustrated in FIG. 3A, and remain secured to the collar of the blouse 40.

Figure 3B:
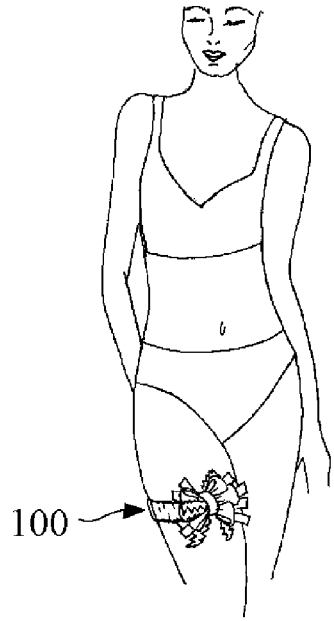
FIG. 3B is a front perspective view of the accessory of FIG. 1 configured as a garter worn on a leg.

FIG. 3B illustrates yet another use for the self-adjusting accessory 100, wherein the self-adjusting accessory may be worn as garter on a leg. While women's pantyhose are often configured so that no garter or garter belt may be required, the self-adjusting accessory 100 of the current disclosure may both provide a utilitarian function of holding hose more securely while also providing enhanced adornment to a woman's leg. Of course, the self-adjusting accessory 100 may also be used on one or more arms to both hold a portion of apparel such as a shirt or blouse in place while also being used as an adornment. Consequently, the self-adjusting accessory 100 may be used by men or women and may be highly suited for entertainer's use during a performance.

Figure 3D:
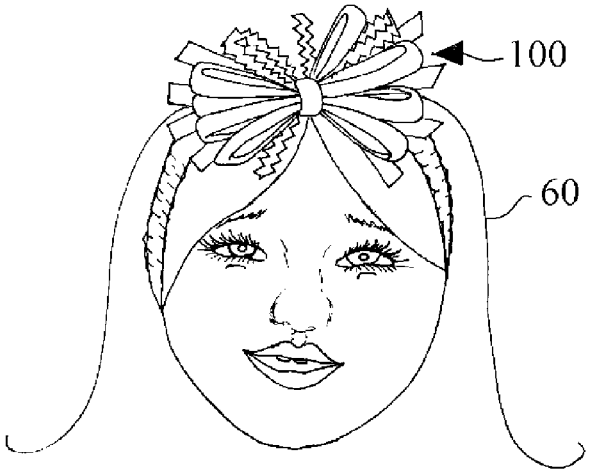
FIG. 3D is a front perspective view of the accessory of FIG. 1 configured as a headband.
Figure 3C:
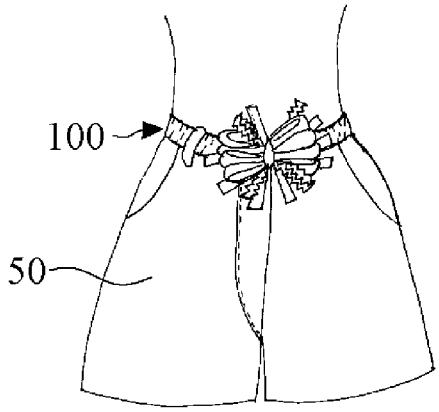
FIG. 3C is a front perspective view of the accessory of FIG. 1 configured as a belt.

FIG. 3C depicts the self-adjusting accessory 100 in use as a belt around a person's waist, which may be coupled to a portion of a pair of pants (or culottes or a dress or a skirt) 50. Naturally, the self-adjusting accessory 100 has both a functional as well as decorative use in this specific application. It may be readily appreciated that while only a single self-adjusting accessory 100 is shown in use in FIG. 3C as a belt, the belt may comprise more than one of the self-adjusting accessories that may be coupled by knotting an end of a first assembly of components 25*a* to an end of a second assembly of components 25*b*. In this manner, the size of a belt may be increased as required. Alternatively, an end of first end of a first assembly of components 25*a* may be coupled to an end of a second assembly of components 25*b*, while an opposite end of the first assembly of components may be coupled to an opposite end of a second assembly of components to provide a dual belt (not shown). This dual belt may then be wrapped around a person's midriff as an adornment and alternatively to hold apparel in place that may otherwise bulge out. In yet another belt-like aspect of the disclosure, the self-adjusting accessory 100 may be configured as a sash (not shown) that may be conveniently stored in a handbag or a pocket and extracted when needed.

In another aspect of the disclosure, as illustrated in FIG. 3D, the self-adjusting accessory 100 may be conveniently used as a headband that both may keep hair 60 in place while also providing an ornamental adornment. Advantageously, the self-adjusting accessory 100 configured as a headband improves on a number of features associated with prior art headbands. For example, plastic combs used as headbands will often break and the comb's teeth may wear out readily. In another example, headbands may comprise stretch knit fabrics, which lose their elasticity over time and may result in an undesirable overall appearance of the headbands. In a further example, prior art headbands may be simple closed loop elastic bands that may be limited in their capability to enclose hair by size considerations and may have unappealing ornamental appearance. In yet another example, headbands may comprise metal and readily cut an adult or child user because of the metal's sharpness. Furthermore, often the metal of such headbands may deteriorate over time and detract from a desired appearance. While not shown in FIG. 3D, it is contemplated that the headband style self-adjusting accessory 100 may be beneficially used to tie back a pony tail of hair 60. Thus, the self-adjusting accessory 100 may be wrapped around hair a number of times and in a number of different ways according to the desires of a person to provide, for example, various bun-like hair 60 appearances and the like. Clearly, the simple construction and nature of materials used in the self-adjusting accessory 100 configured as a headband does not readily break, lose elasticity nor pose a health risk such as cutting a user. Moreover, unlike prior art headbands, the self-adjusting accessory 100 described herein may be readily expanded to fit any suitable size of hair that may need to be enclosed. It should be understood that the number of ways available for use of the self-adjusting accessory 100 to hold hair 60 in place while providing adornment to a personal appearance may be limited only by the creativity of a consumer and therefore provides a significant benefit given the apparent simplicity of the self-adjusting accessory.

Figure 4A:
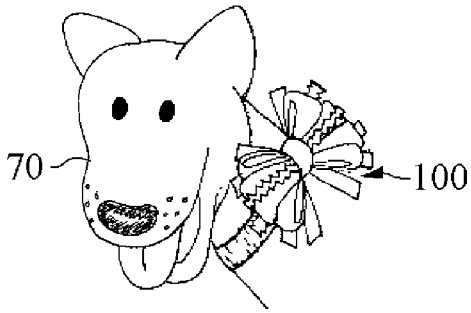
FIG. 4A is a front perspective view of the accessory of FIG. 1 configured as a collar surrounding a neck of an animal or of an animal shaped toy.
Figure 4B:
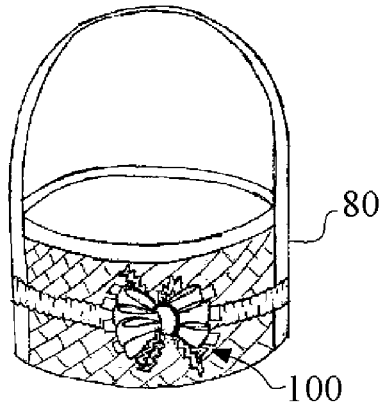
FIG. 4B is a front perspective view of the accessory of FIG. 1 configured as a band surrounding a portion of a basket.
Figure 4C:
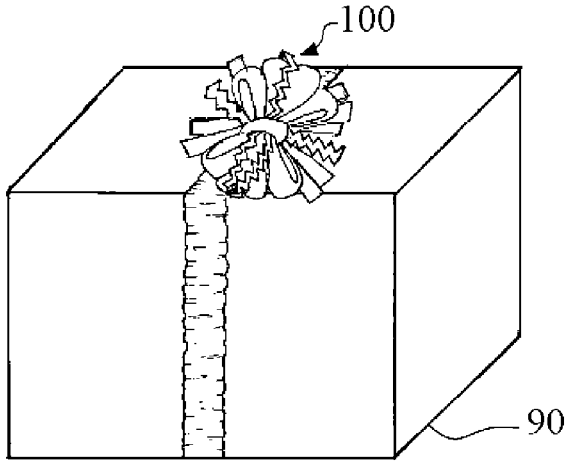
FIG. 4C is a front perspective view of the accessory of FIG. 1 configured as a ribbon surrounding a portion of a box.
Figure 5B:
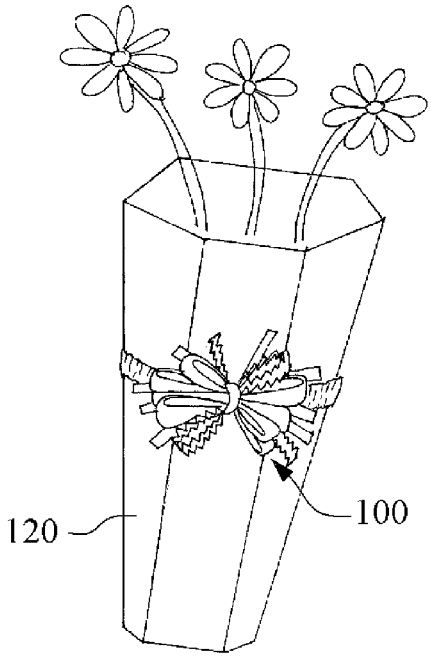
FIG. 5B is a front perspective view of the accessory of FIG. 1 configured as a band surrounding a portion of a vase.
Figure 5A:
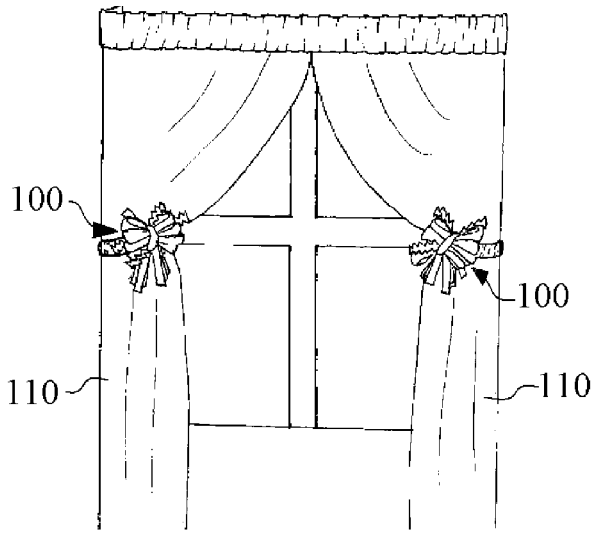
FIG. 5A is a front perspective view of a pair of the accessories of FIG. 1 with each accessory configured as a clasp for each pane of a curtain.
Figure 5C:
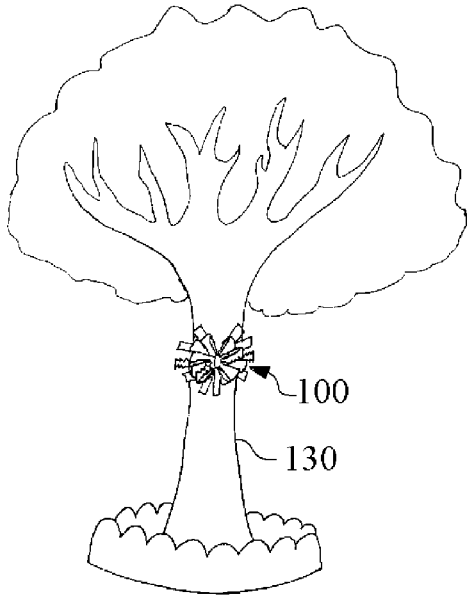
FIG. 5C is a front perspective view of the accessory of FIG. 1 configured as a ribbon surrounding a portion of a tree.

Reference to FIGS. 4A and 4B and 4C, as well as FIGS. 5A and 5B and 5C illustrates how the self-adjusting accessory may both decoratively and functionally coupled to a portion of a variety of one or more objects. Thus, FIG. 4A depicts a front perspective view of the self-adjusting accessory 100 having a bow and configured as a collar surrounding a neck of an animal (or of an animal shaped toy) 70. FIG. 4B depicts a front perspective view of the self-adjusting accessory 100 having a bow and configured as a band surrounding a portion of a basket 80. FIG. 4C depicts a front perspective view of the self-adjusting accessory 100 having a bow and configured as a ribbon surrounding a portion of a box 90 such as a gift box. Of course, the gift box 90 may have any shape and the self-adjusting accessory 100 may conform as desired to couple one or more portions of the box to each other if, for example, the gift box comprises a top and bottom or there is a wrapping paper surrounding the box. In this manner, the self-adjusting accessory 100 may obviate a need for an adhesive or tape while functioning as a securing fastener that surrounds at least a portion of the object.

FIG. 5A depicts a front perspective view of a pair of self-adjusting accessories 100 each having a bow with each self-adjusting accessory configured as a clasp for each pane of a curtain 110. Of course, the curtains 110 may be any type of curtains or a single curtain or may comprise a portion of a pelmet wherein a fabric sheet may decoratively drape over a rod. Furthermore, the curtain 110 may comprise a shower curtain or decorative towels in a bathroom, where the self-adjusting accessory 100 may both restrain one or more decorative towels while also providing an adornment to the bathroom by coordinating with a shower curtain having another self-adjusting accessory. FIG. 5B depicts a front perspective view of the self-adjusting accessory 100 having a bow and configured as a band surrounding a portion of a vase 120. FIG. 5C depicts a front perspective view of the self-adjusting accessory 100 having a bow and configured as a ribbon surrounding a portion of a tree trunk 130. Ribbons surrounding tree trunks 130 have become powerful symbols to remind people of certain events and also as decorative seasonal fixtures.

A great number of uses and configurations of the self-adjusting accessory 100 have been discussed above. However, it should be understood these are merely illustrative of a multiplicity of applications for use of this unique and non-obvious self-adjusting accessory 100.

Figure 6:
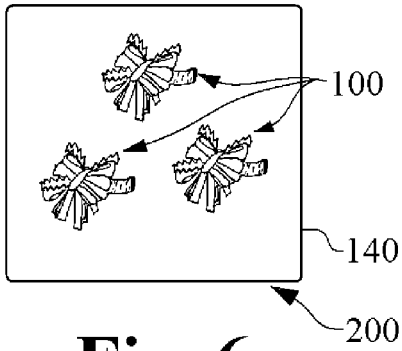
FIG. 6 is a front perspective view of a kit comprising one or more of the accessories of FIG. 1 with each of the accessories having a substantially bow shape and surrounded by an outer packaging material.

In yet another aspect of the disclosure, a kit 200 may comprise a packaging material 140 surrounding one or more of the self-adjusting accessories 100 as depicted in FIG. 6. While the kit's 200 one or more self-adjusting accessories 100 have been illustrated as closed loop bow shaped self-adjusting accessories, it is understood that the self-adjusting accessories may simply be untied and have the open appearance illustrated in FIG. 1 (see description above).

While the invention has been particularly shown and described with reference to preferred embodiments thereof, it will be understood by those skilled in the art that the foregoing and other changes in form and details may be made therein without departing from the spirit and scope of the invention. The scope of the present invention is not intended to be limited by the specific examples set out herein.

What is claimed is:

1. A self-adjusting accessory, comprising in combination:

a base member having a first end and a second end, an inner portion of the base member having a first inner surface and a second inner surface;

the first inner surface of the inner portion of the base member including a self-adjusting member having a length shorter than the outer surface of the base member, the self-adjusting member having a first end and a second end;

a portion of the first end of the self-adjusting member coupled to the first inner surface of the inner portion of the first end of the base member and a portion of the second end of the self-adjusting member coupled to the first inner surface of the inner portion of the second end of the base member;

one or more assemblies of at least one streamer members, each of the at least one streamer members having an end and an opposite end;

a portion of each end of each of the at least one streamer members of a first assembly coupled to the inner a portion of the first end of the base member and a portion of the first end of the self-adjusting member;

a portion of each end of each of the at least one streamer members of another assembly coupled to the inner portion of the second end of the base member and a portion of the second end of the self-adjusting member, a portion of the first inner surface of the base member proximate to an edge of the self-adjusting member folded over the self-adjusting member, the end of each of the first assembly and the end of the another assembly and a portion of an outer edge of the second inner surface of the base member coupled to a portion of an outer edge of the first inner surface of the base member to substantially enclose each of the self-adjusting member, the end of each of the first assembly and the end of the another assembly within the inner portion of the base member, wherein a portion of the base member self-adjusts to conform to an outer surface of an object when at least a portion of at least one of the opposite ends of at least one streamer member of each of the first assembly and the another assembly couples to at least one of a portion of the object and a portion of the self-adjusting accessory.

2. The accessory of claim 1, wherein the self-adjusting member substantially comprising one or more pliable materials of a stretchable fabric, the self-adjusting member more deformable than the base member.

3. The accessory of claim 1, wherein the one or more streamer members is at least a fabric selected from the group consisting of a base, a mesh, a lace, a satin, a rick rack and one or more combination of the fabrics thereof.

4. The accessory of claim 1, comprising a fastener selectively coupled to a portion of the edge of the first inner surface of the base member and a portion of the edge of the second inner surface of the base member.

5. The accessory of claim 4, wherein the fastener is selected from the group consisting of a least one of thread, permanent adhesive, semi-permanent adhesive and a mechanical hook and loop arrangement.

6. The accessory of claim 1, comprising the first assembly having more than two streamer members and the another assembly having more than two streamer members.

7. The accessory of claim 1, wherein one or more of the self-adjusting accessories is configured as a kit surrounded by a packaging material.

8. The accessory of claim 1, wherein the object is selected from the group comprising at least one of the following: a hat, a neck-tie, a garter, a belt, a sash, a headband, a collar, a gift box, a curtain pane, a vase and a tree ribbon.

9. A method of producing a self-adjusting accessory, comprising the steps of:

providing a base member having a first end and a second end;

coupling at least an inner portion of the base member to a self-adjusting member having a first end and a second end, the self-adjusting member having a length shorter than the base member;

providing an assembly of components comprising at least two streamer members, at least one of the streamer members visually distinguishable from another of the streamer members;

coupling a portion of an end of the assembly of components to a portion of the first end of the base member;

coupling a portion of an end of a second assembly of components to the second end of the base member;

folding an inner edge of the base member to substantially enclose each of the self-adjusting member, an end of each of the assembly of components and the second assembly of components within an inner portion of the base member; and coupling a portion of an edge of the base member to a portion of an opposite edge of the base member to encase the self-adjusting member and an end of each of the assembly of components and the second assembly of components within an inner portion of the base member and thereby provide the self-adjusting accessory.

* * * * *